US011728121B2

(12) United States Patent
Ishii et al.

(10) Patent No.: US 11,728,121 B2
(45) Date of Patent: Aug. 15, 2023

(54) X-RAY MODULE

(71) Applicant: HAMAMATSU PHOTONICS K.K., Hamamatsu (JP)

(72) Inventors: Atsushi Ishii, Hamamatsu (JP); Akihito Kobayashi, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 16 days.

(21) Appl. No.: 17/572,871

(22) Filed: Jan. 11, 2022

(65) Prior Publication Data

US 2022/0238293 A1 Jul. 28, 2022

(30) Foreign Application Priority Data

Jan. 22, 2021 (JP) ..... 2021-009013

(51) Int. Cl.

| | |
|---|---|
| ***H01J 35/12*** | (2006.01) |
| ***H01J 35/18*** | (2006.01) |
| ***H05G 1/02*** | (2006.01) |
| ***H01J 35/14*** | (2006.01) |

(52) U.S. Cl.

CPC ..... *H01J 35/12* (2013.01); *H01J 35/186* (2019.05); *H01J 35/153* (2019.05); *H01J 35/18* (2013.01); *H01J 2235/122* (2013.01); *H01J 2235/1204* (2013.01); *H01J 2235/1216* (2013.01); *H01J 2235/1245* (2013.01);

(Continued)

(58) Field of Classification Search

CPC .. H01J 35/12; H01J 35/186; H01J 2235/1204; H01J 2235/1216; H01J 2235/122; H01J 2235/1245; H01J 2235/1283; H01J 2235/1291

See application file for complete search history.

(56) References Cited

U.S. PATENT DOCUMENTS

| | | | | |
|---|---|---|---|---|
| 10,178,748 | B1 * | 1/2019 | Steck ..... | H01J 35/13 |
| 2014/0140486 | A1 * | 5/2014 | Yanagisawa ..... | H01J 35/13 378/141 |
| 2017/0094761 | A1 * | 3/2017 | Miller ..... | H01J 35/06 |

(Continued)

FOREIGN PATENT DOCUMENTS

| | | | |
|---|---|---|---|
| JP | 3950389 | B2 | 8/2007 |
| JP | 2013-055041 | A | 3/2013 |

(Continued)

*Primary Examiner* — Chih-Cheng Kao

(74) *Attorney, Agent, or Firm* — Faegre Drinker Biddle & Reath LLP

(57) ABSTRACT

An X-ray module includes a housing in which an opening portion is formed; an electron gun that emits an electron beam; a target that transmits an X-ray generated when the electron beam is incident on the target and emits the X-ray from an X-ray-emitting surface; an X-ray-emitting window that seals the opening portion, and that transmits the X-ray and emits the X-ray to a first side in an axial direction; and a heat radiating unit disposed outside the housing. The housing includes a surface on which a protrusion protruding to the first side is formed, the opening portion is formed in the protrusion, and the target is disposed in the opening portion. The heat radiating unit includes a first portion extending along the surface and thermally connected to the surface, and a second portion extending from the first portion to a second side opposite the first side.

11 Claims, 9 Drawing Sheets

(52) U.S. Cl.
CPC ..... *H01J 2235/1283* (2013.01); *H01J 2235/1291* (2013.01); *H01J 2235/18* (2013.01); *H05G 1/025* (2013.01)

(56) References Cited

U.S. PATENT DOCUMENTS

| | | | | |
|---|---|---|---|---|
| 2019/0341220 | A1* | 11/2019 | Parker | H01J 35/12 |
| 2021/0368609 | A1* | 11/2021 | Bailey | A61B 6/035 |

FOREIGN PATENT DOCUMENTS

| | | | |
|---|---|---|---|
| JP | 5179797 | B2 | 4/2013 |
| JP | 5478873 | B2 | 4/2014 |
| JP | 2018-190525 | A | 11/2018 |

* cited by examiner

X-RAY MODULE

TECHNICAL FIELD

One aspect of the present disclosure relates to an X-ray module.

BACKGROUND

An X-ray module has been known in which an electron gun that emits an electron beam and a target that generates an X-ray when the electron beam is incident on the target are disposed inside a housing and which outputs the X-ray from an output window that closes an opening portion of the housing (for example, refer to Japanese Patent No. 5179797).

In the above-described X-ray module, a decrease in focus to object distance (FOD) is required in some cases. For example, in a case where the X-ray module is used for a non-destructive inspection, when the FOD that is a distance from an X-ray focal point (irradiation point of the electron beam on the target) to an inspection object is small, observation at a high magnification ratio can be performed. Alternatively, when it is assumed that the magnification ratio remains equal, an X-ray imaging element can be disposed close to an X-ray source, so that a bright image can be acquired.

In addition, in the above-described X-ray module, an efficiency of conversion of the electron beam into the X-ray in the target is approximately 1%, and approximately 99% of the incident electron beam becomes heat. For this reason, in order to suppress a decrease in X-ray output caused by damage of the target due to heat, heat generated in the target needs to be satisfactorily radiated.

SUMMARY

Therefore, an object of one aspect of the present disclosure is to provide an X-ray module capable of satisfactorily radiating heat generated in a target while suppressing an increase in FOD.

According to one aspect of the present disclosure, there is provided an X-ray module including: a housing in which an opening portion is formed; an electron gun that emits an electron beam inside the housing; a target that includes an electron-incident surface and an X-ray-emitting surface opposite the electron-incident surface, and that transmits an X-ray generated when the electron beam is incident on the electron-incident surface and emits the X-ray from the X-ray-emitting surface; an X-ray-emitting window that seals the opening portion, and that transmits the X-ray emitted from the target and emits the X-ray to a first side in an axial direction; and a heat radiating unit disposed outside the housing. The housing includes a surface on which a protrusion protruding to the first side is formed, the opening portion is formed in the protrusion, and the target is disposed in the opening portion. The heat radiating unit includes a first portion extending along the surface and thermally connected to the surface, and a second portion extending from the first portion to a second side opposite the first side.

In the X-ray module, the target includes the electron-incident surface and the X-ray-emitting surface, transmits the X-ray generated when the electron beam is incident on the electron-incident surface, and emits the X-ray from the X-ray-emitting surface. In such a transmission type configuration, the target is more easily disposed close to the X-ray-emitting window and a FOD can be more reduced than in a reflection type configuration in which an electron-incident surface also serves as an X-ray-emitting surface. In addition, the protrusion protruding to the first side is formed on the surface of the housing, and the target is disposed in the opening portion formed in the protrusion. For this reason, the FOD can be further reduced. Then, the heat radiating unit includes the first portion extending along the surface and thermally connected to the surface. Accordingly, the heat radiating unit can be disposed using a space corresponding to a height of the protrusion, and heat generated in the target can be satisfactorily radiated while suppressing an increase in FOD. Further, the heat radiating unit includes the second portion extending from the first portion to the second side opposite the first side. Accordingly, heat radiation by the heat radiating unit can be improved while suppressing an increase in FOD. Therefore, the X-ray module is capable of satisfactorily radiating heat generated in the target while suppressing an increase in FOD.

The second portion may be located outside an outer edge of the surface when viewed in the axial direction, and may be located closer to the second side in the axial direction than the surface. In this case, heat radiation by the heat radiating unit can be improved while suppressing an increase in FOD.

The first portion may surround the protrusion when viewed in the axial direction. In this case, heat generated in the target can be more satisfactorily radiated.

The heat radiating unit may not protrude to the first side with respect to the protrusion. In this case, the FOD can be further reduced.

A surface of the heat radiating unit on the first side may be located on the same plane as a surface of the protrusion on the first side. In this case, the thickness of the first portion can be secured and heat radiation by the heat radiating unit can be improved while suppressing an increase in FOD.

A surface of the X-ray-emitting window on the first side may be located on the same plane as a surface of the heat radiating unit on the first side. In this case, the FOD can be further reduced.

The X-ray module according to one aspect of the present disclosure may further include a heat conducting member disposed between the first portion and the surface. In this case, heat generated in the target can be more satisfactorily radiated.

The second portion may include a plurality of fins. In this case, heat radiation by the heat radiating unit can be further improved.

The first portion and the second portion may be formed in a pipe shape. In this case, for example, the first portion and the second portion can be used as a pipe for a cooling medium, a heat pipe, or the like, and heat radiation by the heat radiating unit can be further improved.

Each of the first portion and the second portion may define a flow path between the housing and the member for letting a cooling medium flowing. In this case, heat radiation by the heat radiating unit can be further improved.

The X-ray module according to one aspect of the present disclosure may further include a deflection unit that includes a permanent magnet, and that deflects the electron beam by means of a magnetic force of the permanent magnet. The second portion may be thermally connected to the deflection unit. In this case, the position of an X-ray focal point can be moved to a desired position by the deflection unit. In addition, the heating of the permanent magnet by heat generated in the target can be suppressed, and the X-ray can be stably output.

According to one aspect of the present disclosure, it is possible to provide the X-ray module capable of satisfactorily radiating heat generated in the target while suppressing an increase in FOD.

DETAILED DESCRIPTION

Hereinafter, one embodiment of the present disclosure will be described in detail with reference to the drawings. In the following description, the same reference signs are used for the same or corresponding elements, and duplicated descriptions will be omitted.

[X-Ray Generation Device]

Figure 1:
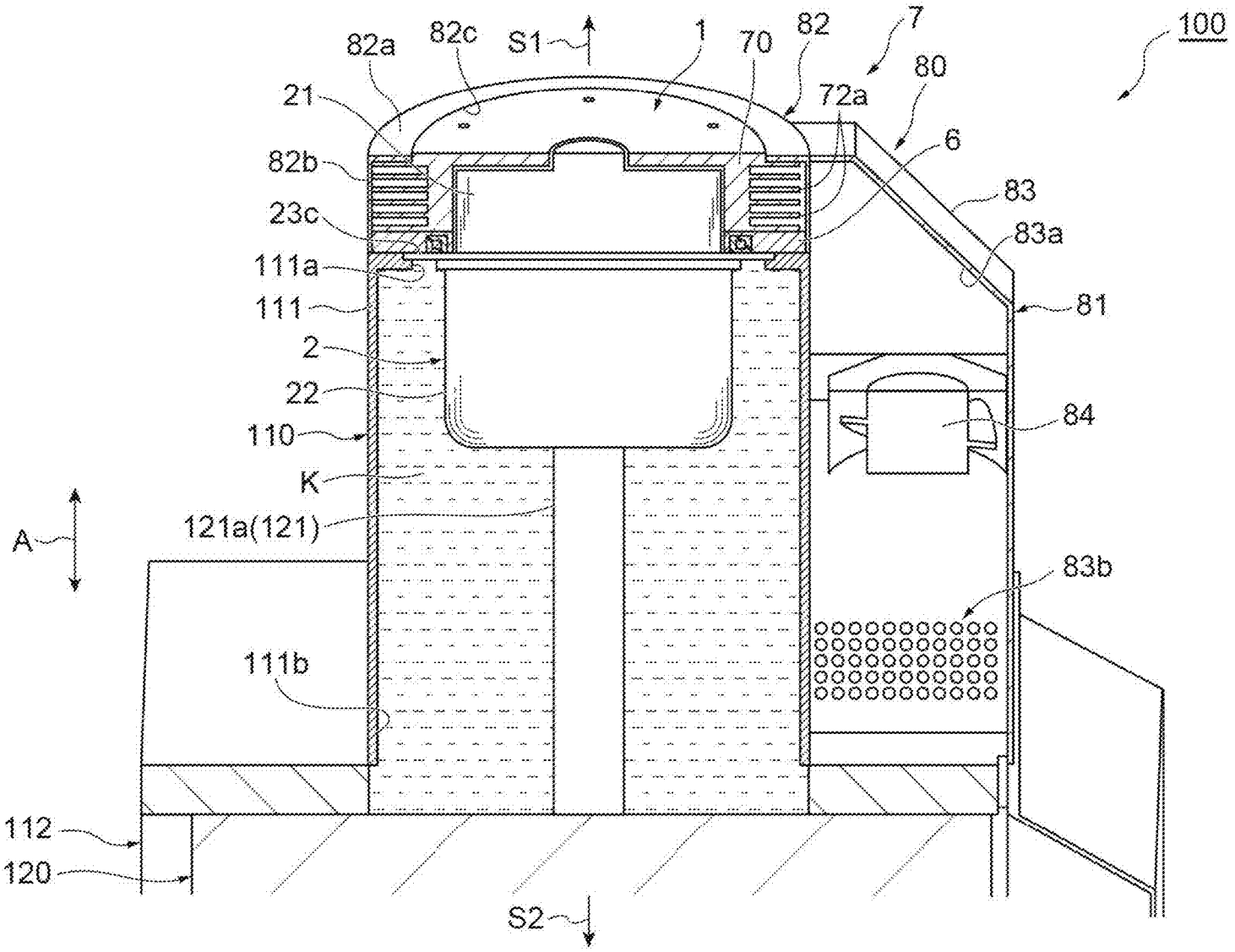
FIG. 1 is a cross-sectional view of an X-ray generation device according to an embodiment.
Figure 2:
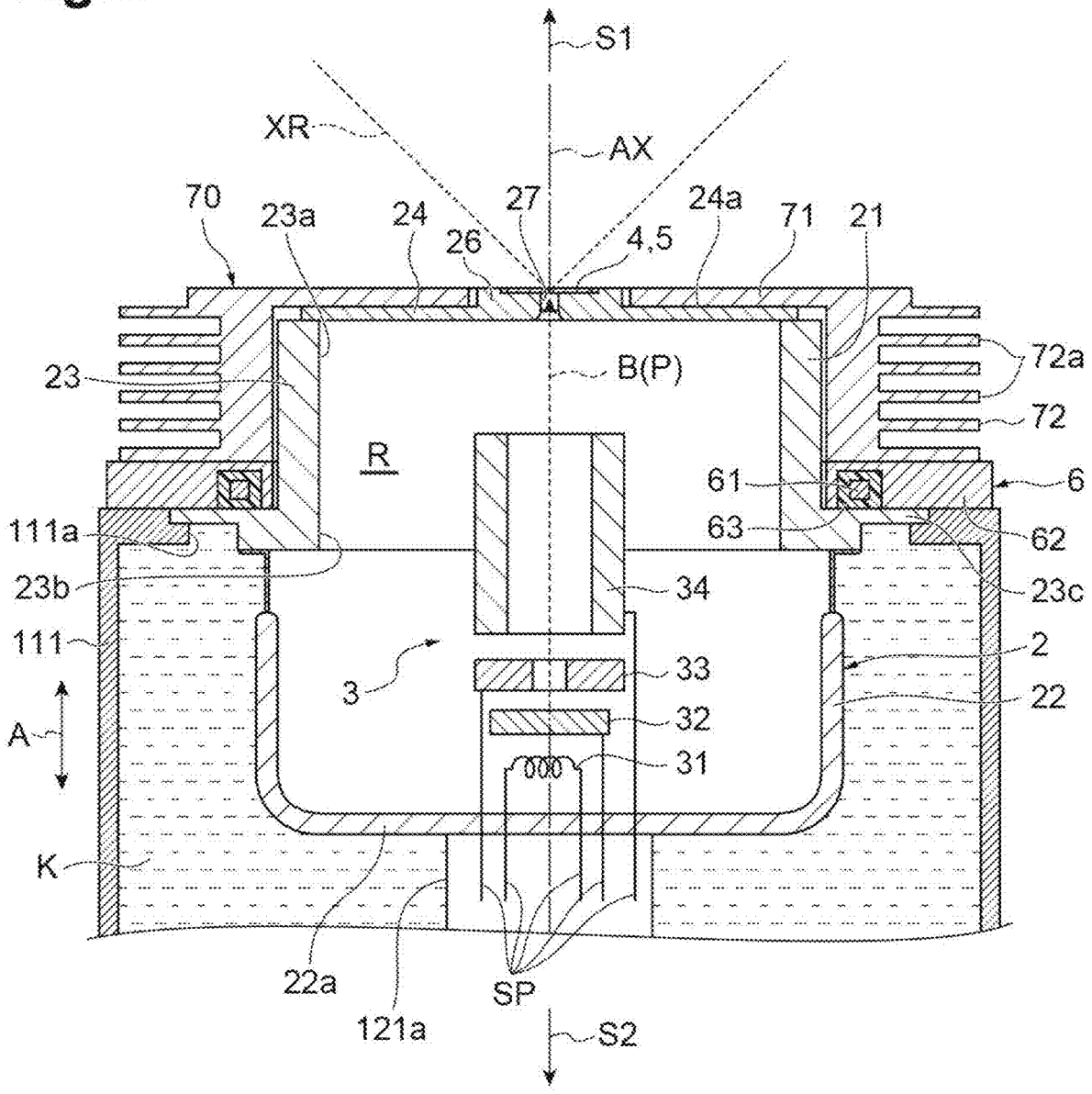
FIG. 2 is a cross-sectional view of an X-ray tube.
Figure 3:
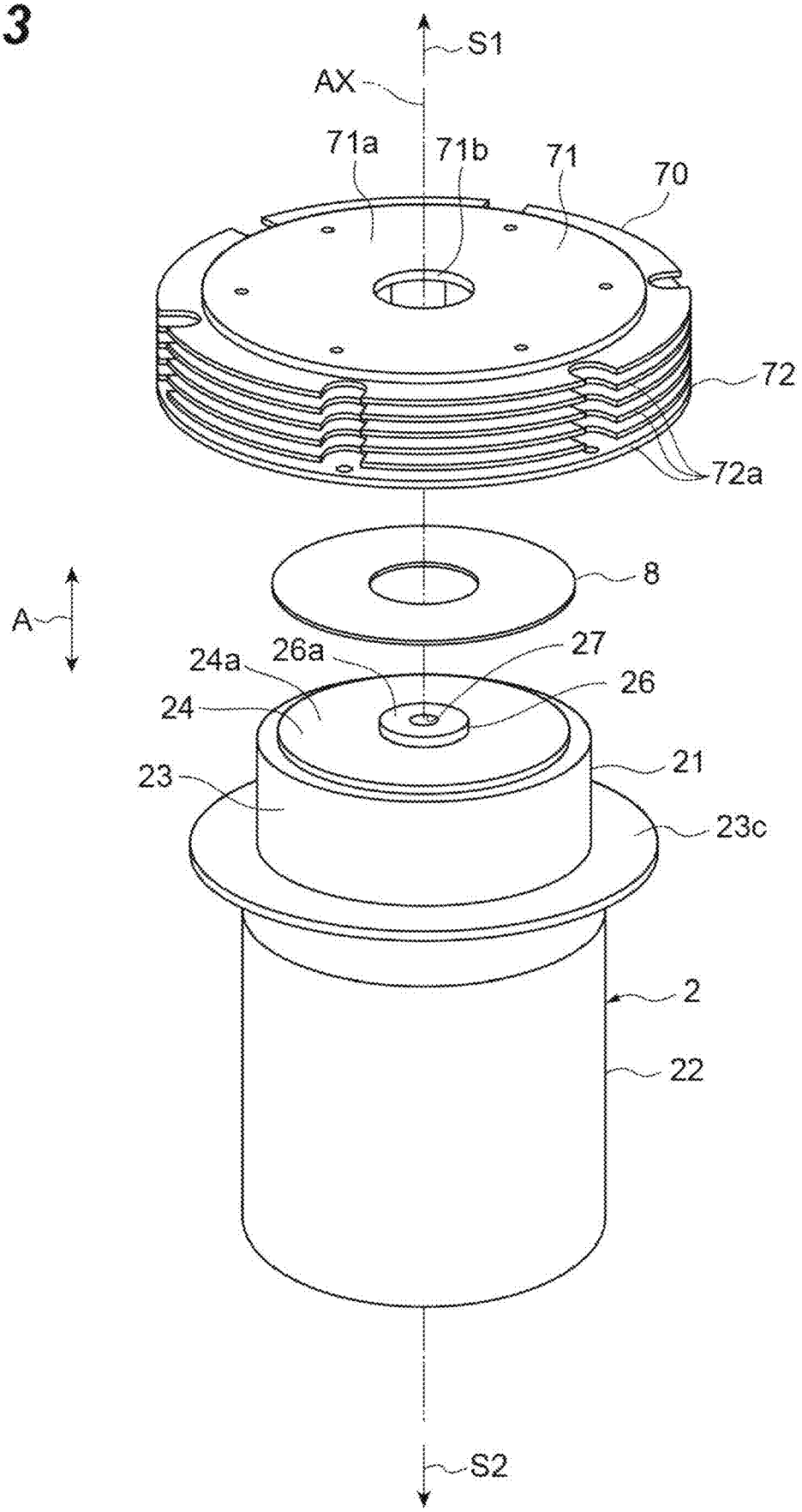
FIG. 3 is an exploded perspective view of the X-ray tube.

An X-ray generation device (X-ray module) 100 illustrated in FIG. 1 is, for example, a microfocus X-ray source used for an X-ray non-destructive inspection in which an internal structure of an inspection object is observed. The X-ray generation device 100 includes an X-ray tube 1, a heat radiating unit 7, a case 110, and a power source unit 120. As illustrated in FIG. 2, the X-ray tube 1 is a transmission type X-ray tube that emits an X-ray XR from an X-ray-emitting window 5 in a direction along an incident direction of an electron beam B, the X-ray XR being generated when the electron beam B from an electron gun 3 is incident on a target 4 and transmitting through the target 4 itself. The X-ray tube 1 is a vacuum-sealed x-ray tube that includes a housing 2 having an internal space R in a vacuum state and does not require component replacement or the like. In the following description, it is assumed that a direction parallel to a tube axis AX of the X-ray tube 1 is an axial direction A, one side (upper side in the drawings) in the axial direction A is a first side S1, and the other side (side opposite the first side S1) in the axial direction A is a second side S2. In the X-ray tube 1, an optical axis of the electron beam B coincides with an optical axis the X-ray XR.

The housing 2 has a substantially columnar outer shape. The housing 2 includes a head portion 21 made of a metal material and an insulating valve 22 made of an insulating material such as glass. The target 4 and the X-ray-emitting window 5 are fixed to the head portion 21.

The electron gun 3 is fixed to the insulating valve 22. The electron gun 3 emits the electron beam B in the internal space R. For example, the electron gun 3 is configured such that a heater 31, a cathode 32, a first grid electrode 33, and a second grid electrode 34 are disposed side by side in order from the second side S2. The heater 31 is formed of a filament that is energized to generate heat. The cathode 32 is heated by the heater 31 to emit electrons. The first grid electrode 33 and the second grid electrode 34 are formed in a cylindrical shape. The first grid electrode 33 is provided to control the amount of electrons emitted from the cathode 32, and the second grid electrode 34 is provided to focus the electrons, which have passed through the first grid electrode 33, toward the target 4. The heater 31, the cathode 32, the first grid electrode 33, and the second grid electrode 34 are electrically connected to a plurality of stein pins SP provided to penetrate through a bottom portion 22*a* of the insulating valve 22.

The case 110 includes a cylindrical member 111 and a power source unit case 112. The case 110 is made of a metal material. The cylindrical member 111 is formed in a substantially cylindrical shape, and includes an opening 111*a* and an opening 111*b* at both ends in the axial direction A. The X-ray tube 1 is inserted into the opening 111*a* such that the head portion 21 protrudes from the opening 111*a*. An attachment flange 23*c* of the X-ray tube 1 is fixed to an end portion on the first side S1 of the cylindrical member 111. Accordingly, the X-ray tube 1 seals the opening 111*a*. An insulating oil K that is a liquid insulating substance is sealed in the cylindrical member 111.

The power source unit 120 supplies electric power to the X-ray tube 1. The power source unit 120 is housed in the power source unit case 112. The power source unit 120 seals the opening 111*b* of the cylindrical member 111. The power source unit 120 includes a high-voltage power supply portion 121 including a connector 121*a* having a cylindrical shape. The high-voltage power supply portion 121 is electrically connected to the X-ray tube 1. Specifically, a tip portion of the connector 121*a* is electrically connected to the stein pins SP protruding from the bottom portion 22*a* of the insulating valve 22. In this example, with the target 4 (anode) having a ground potential, and a negative high voltage (for example, −10 kV to −500 kV) is supplied from the power source unit 120 to the electron gun 3 via the high-voltage power supply portion 121.

[X-Ray Tube]

As illustrated in FIGS. 1 to 7, the X-ray tube 1 includes the housing 2, the electron gun 3, the target 4, the X-ray-emitting window 5, and a deflection unit 6. As described above, the housing 2 includes the head portion 21 and the insulating valve 22. The head portion 21 corresponds to an anode of the X-ray tube 1 in terms of electrical potential. The head portion 21 includes a body portion 23 and a lid portion 24. The body portion 23 is made of, for example, stainless steel (for example, SUS304), copper, an iron alloy, a copper alloy, or the like in a substantially cylindrical shape coaxial with the tube axis AX, and includes openings 23*a* and 23*b* at both ends in the axial direction A. The opening 23*a* is closed by the lid portion 24. The lid portion 24 is fixed to an edge portion of the opening 23*a*. The body portion 23 communicates with the insulating valve 22 through the opening 23*b*, the insulating valve 22 having a substantially cylindrical shape coaxial with the tube axis AX. An outer peripheral surface of the body portion 23 is provided with the attachment flange 23*c* that is formed in a substantially annular plate shape concentric with the body portion 23.

The lid portion 24 is made of, for example, molybdenum in a substantially circular plate shape coaxial with the tube axis AX, and closes the opening 23*a* of the body portion 23. A protrusion 26 protruding to the first side S1 with respect to a surface 24*a* of the lid portion 24 on the first side S1 is formed on the surface 24*a*. The surface 24*a* has a circular shape, and the protrusion 26 is formed in a columnar shape concentric with the lid portion 24. An opening portion 27 penetrating through the lid portion 24 along the axial direction A is formed in the protrusion 26.

Figure 4:
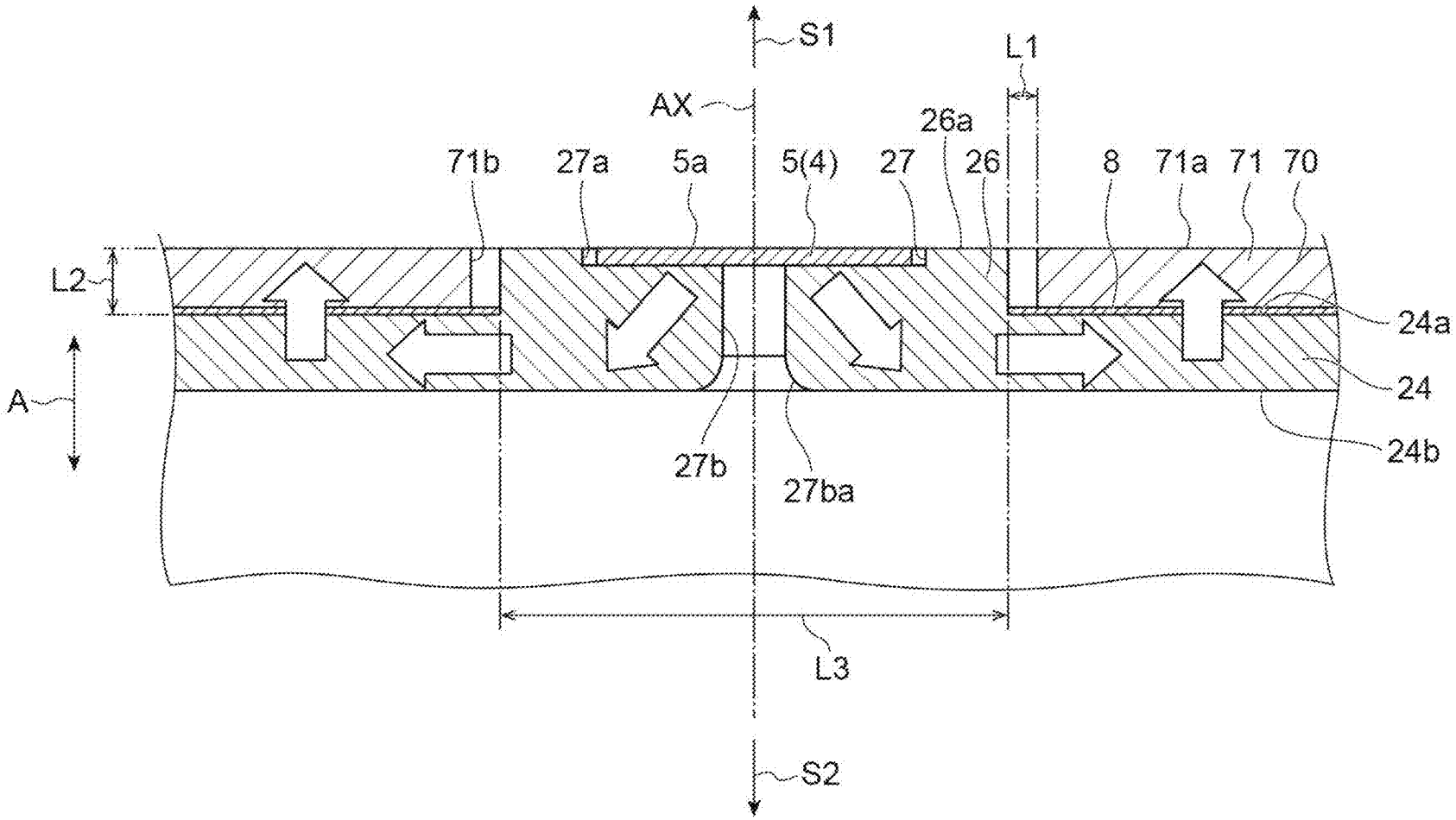
FIG. 4 is a cross-sectional view illustrating a periphery of a protrusion.
Figure 5:
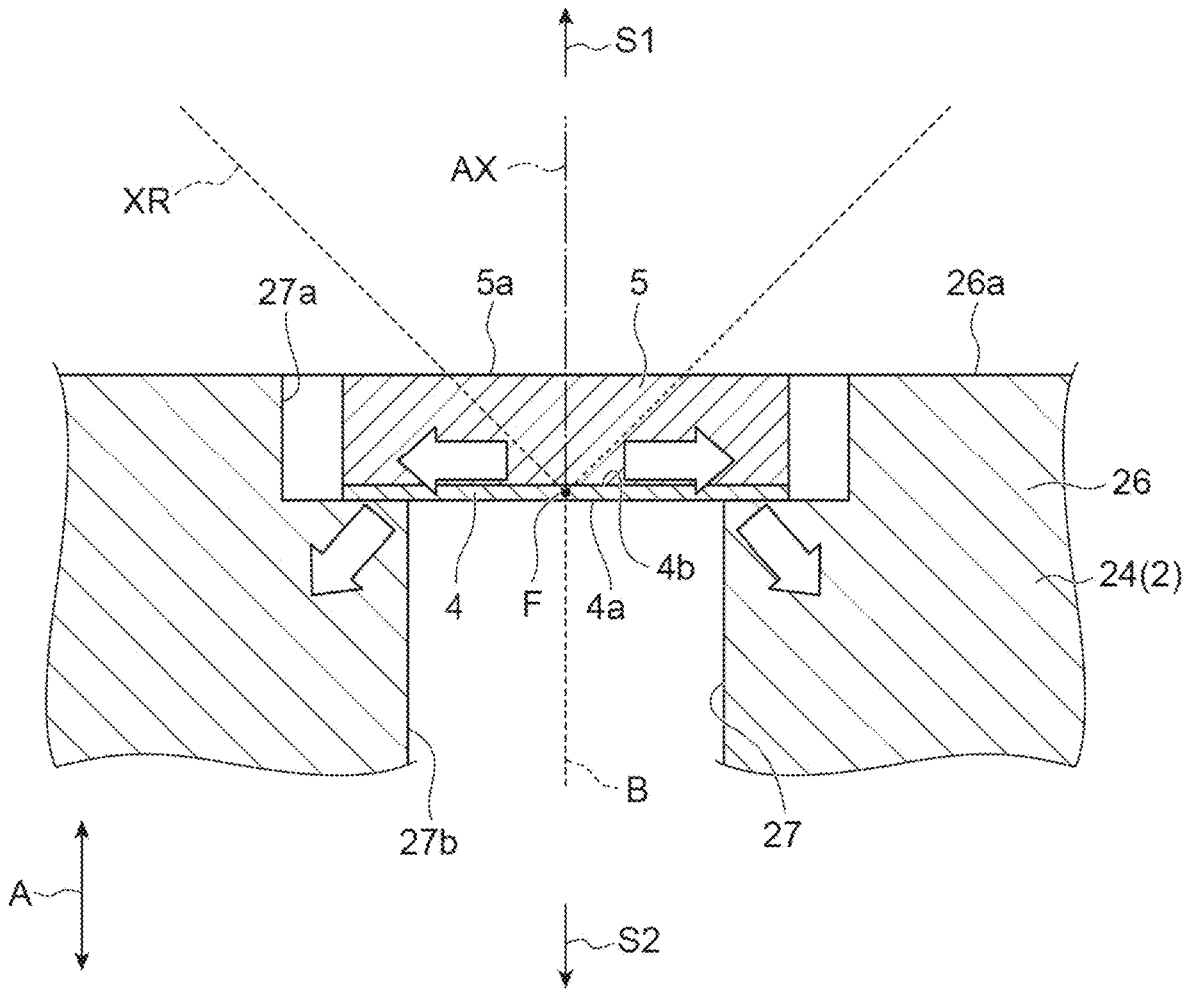
FIG. 5 is a cross-sectional view illustrating a periphery of a target.
Figure 6:
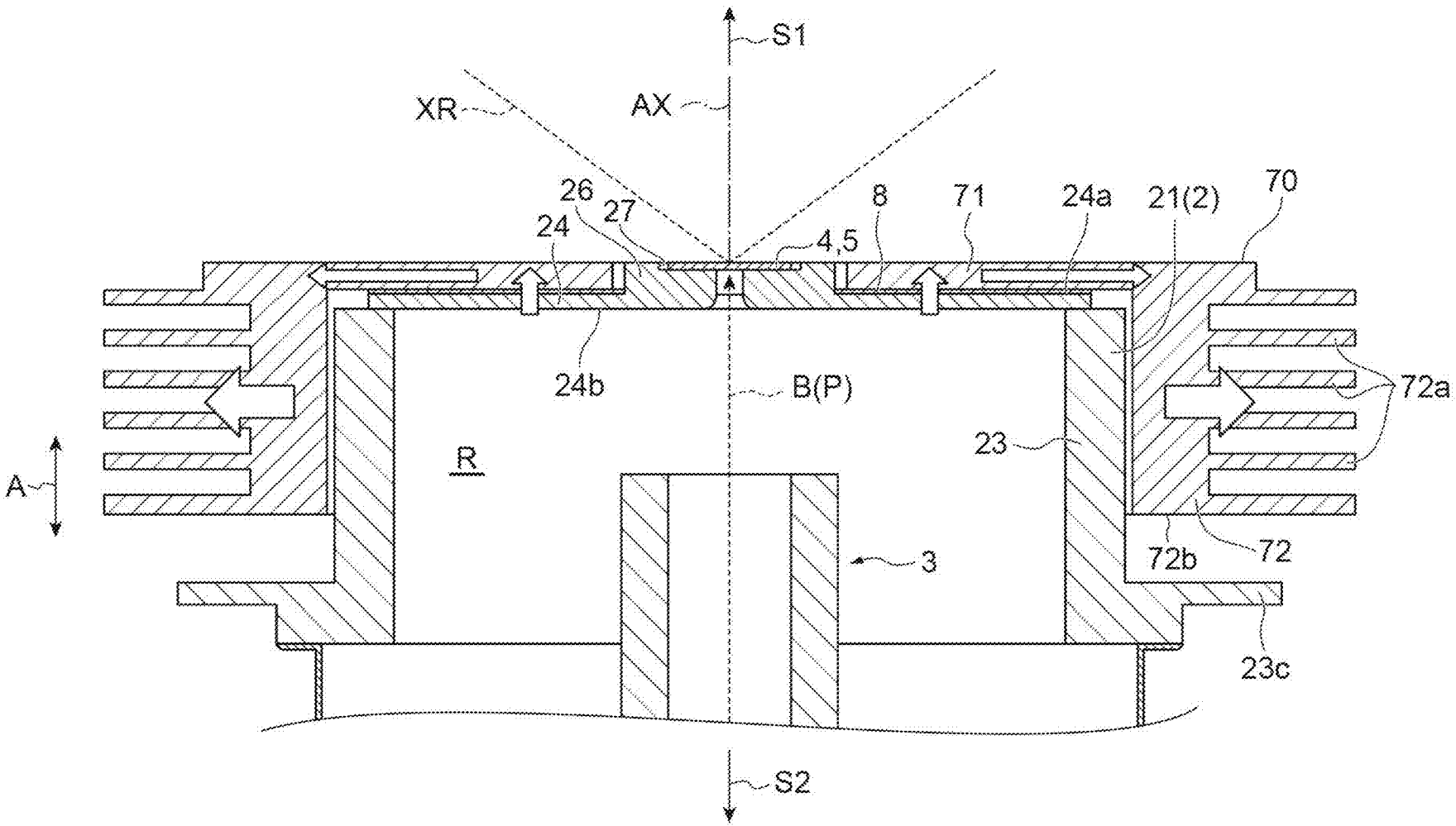
FIG. 6 is a cross-sectional view of the X-ray tube.

As illustrated in FIGS. 4 to 6, the opening portion 27 includes a first portion 27*a* that is open to a surface 26*a* of the protrusion 26 on the first side S1, and a second portion 27*b* that communicates with the first portion 27*a* and that is open to a surface 24*b* of the lid portion 24 on the second side S2. Each of the first portion 27*a* and the second portion 27*b* is formed in a circular shape in cross section which is concentric with the protrusion 26. A diameter of the first portion 27*a* is larger than a diameter of the second portion 27*b*, and a depth of the first portion 27*a* is shallower than a depth of the second portion 27*b*. In other words, the first portion 27*a* is a recess formed in the surface 26*a* of the protrusion 26, and the second portion 27*b* is a through-hole formed in a bottom surface of the first portion 27*a*. The first portion 27*a* functions as a disposition portion in which the target 4 and the X-ray-emitting window 5 are disposed. The second portion 27*b* functions as an electron beam passage hole through which the electron beam B to be incident on the target 4 passes. An end portion of the second portion 27*b* on the second side S2 is provided with a widening portion 27*ba* of which the diameter increases toward the second side S2, and is chamfered in a curved surface shape so as not to form a corner.

The target 4 and the X-ray-emitting window 5 are disposed in the first portion 27*a*. The target 4 is made of, for example, tungsten, and includes an electron-incident surface 4*a* and an X-ray-emitting surface 4*b* on a side opposite the electron-incident surface 4*a*. The target 4 transmits an X-ray generated when the electron beam B is incident on the electron-incident surface 4*a*, and emits the X-ray from the X-ray-emitting surface 4*b*. In this example, the target 4 is formed in a film shape on an entirety of a surface on the second side S2 of the X-ray-emitting window 5. Namely, the target 4 is integrally formed with the X-ray-emitting window 5. The target 4 is disposed such that the electron-incident surface 4*a* faces the second side S2 and the X-ray-emitting surface 4*b* faces the first side S1. A thickness of the target 4 is, for example, approximately several μm.

The X-ray-emitting window 5 is made of, for example, a highly radiolucent material such as diamond or beryllium in a circular plate shape. The X-ray-emitting window 5 is disposed coaxially with the tube axis AX on the bottom surface of the first portion 27*a* of the opening portion 27, is fixed to the bottom surface by a joining member such as a brazing material (not illustrated), and seals the opening portion 27. The X-ray-emitting window 5 is in thermal contact with the bottom surface of the first portion 27*a* via the target 4. In this example, a surface 5*a* of the X-ray-emitting window 5 on the first side S1 is located on substantially the same plane as the surface 26*a* of the protrusion 26 on the first side S1. The X-ray-emitting window 5 faces the electron gun 3 in the axial direction A, transmits the X-ray XR emitted from the target 4, and emits the X-ray XR to the first side S1 in the axial direction A. As illustrated in FIG. 5, the X-ray XR is generated at an X-ray focal point F that is an irradiation point of the electron beam B on the target 4, and is emitted while spreading around the X-ray focal point F. The target 4 may be provided in only a region exposed to the second portion 27*b* on the surface of the X-ray-emitting window 5, or a part of the target 4 may also be provided on a wall surface of the second portion 27*b*. In addition, the target 4 and the X-ray-emitting window 5 may be provided away from each other.

Figure 7:
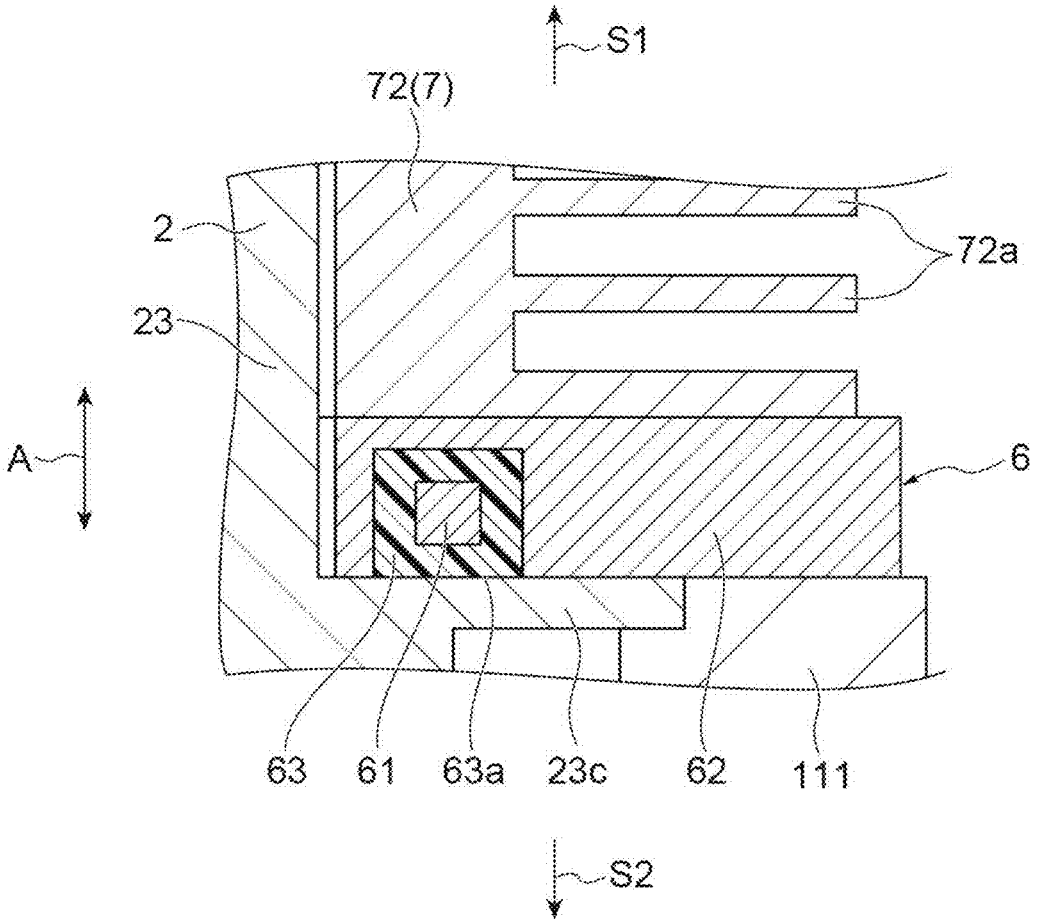
FIG. 7 is a cross-sectional view illustrating a periphery of a deflection unit.

As illustrated in FIGS. 2 and 7, the deflection unit 6 includes a plurality of permanent magnets 61, a holding member 62, and a heat insulating member 63. The deflection unit 6 includes a pair of the permanent magnets 61 facing each other in a radial direction. The pair of permanent magnets 61 are disposed such that different poles face each other in the radial direction. The permanent magnet 61 is formed of, for example, a ferrite magnet, a neodymium magnet, a samarium cobalt magnet, an alnico magnet, or the like.

The holding member 62 is made of, for example, a metal material such as aluminum in a flat cylindrical shape (annular shape) coaxial with the tube axis AX, and holds the permanent magnets 61. The holding member 62 is disposed outside the housing 2, and is fixed to the attachment flange 23*c* in a state where the holding member 62 is in contact with a surface of the attachment flange 23*c* of the body portion 23 on the first side S1. The holding member 62 overlaps a part of the body portion 23 in the radial direction, and is disposed close to the body portion 23 to cover a part of the outer peripheral surface of the body portion 23. The holding member 62 is slightly separated from the body portion 23 in the radial direction, but may be in contact with the body portion 23. In addition, the holding member 62 may be formed of a plurality of members instead of being a cylindrical (annular) integrated member.

The heat insulating member 63 is made of, for example, a resin material such as silicone resin, epoxy resin, acrylic resin, polyimide resin, polyphenylene sulfide (PPS) resin, polyetheretherketone resin (PEEK). In order to suppress a decrease in the magnetic force of the permanent magnets 61 caused by a heat treatment when the heat insulating member 63 is cured, silicone resin, epoxy resin, and acrylic resin that is curable at room temperature are preferably used as the material of the heat insulating member 63.

The heat insulating member 63 houses the permanent magnet 61 inside. Namely, the permanent magnet 61 is disposed inside the heat insulating member 63 in a state where the permanent magnet 61 is surrounded by the heat insulating member 63. For example, the heat insulating member 63 is fixed to the holding member 62, and the holding member 62 holds the permanent magnet 61 via the heat insulating member 63. The heat insulating member 63 isolates the permanent magnet 61 from the holding member 62. A surface 63*a* of the heat insulating member 63 on the second side S2 is in contact with the surface of the attachment flange 23*c* of the body portion 23 on the first side S1. An outer surface other than the surface 63*a* in the heat insulating member 63 is covered with the holding member 62. Namely, the heat insulating member 63 is provided such that the heat insulating member 63 is embedded in the holding member 62 and only the surface 63*a* is exposed from the holding member 62. In such a manner, the heat insulating member 63 includes a portion disposed between the permanent magnet 61 and the attachment flange 23*c* of the body portion 23. The configuration of the heat insulating member 63 is not limited to the configuration in which the heat insulating member 63 houses the permanent magnet 61 inside. For example, a configuration may be adopted in which the holding member 62 directly holds the permanent magnet 61 and the heat insulating member 63 having a plate shape is interposed between the holding member 62 and the body portion 23 to partition between the holding member 62 and the surface of the attachment flange 23*c* of the body portion 23 on the first side S1.

The deflection unit 6 deflects the electron beam B by means of the magnetic force of the permanent magnets 61 to change the position of the X-ray focal point F. When viewed in a direction (radial direction) perpendicular to a path P along which the electron beam B emitted from the electron gun 3 travels to the target 4, the deflection unit 6 includes a portion overlapping the path P. Accordingly, the magnetic force of the permanent magnets 61 can be suitably applied to the electron beam B. In this example, an entirety of the deflection unit 6 overlaps the path P when viewed in the radial direction. The deflection unit 6 is attached to the attachment flange 23*c* such that an imaginary line connecting the pair of permanent magnets 61 facing each other is substantially orthogonal to the tube axis AX. The deflection unit 6 may be rotatable around the tube axis AX. In this case, the position of the X-ray focal point F can be moved by rotating the deflection unit 6.

A thermal conductivity of the holding member 62 is higher than a thermal conductivity of the permanent magnet 61. A thermal conductivity of the heat insulating member 63 is lower than a thermal conductivity of the body portion 23 of the housing 2 (portion of the housing 2 in contact with the deflection unit 6). Namely, heat insulation of the heat insulating member 63 is higher than heat insulation of the body portion 23. In addition, the thermal conductivity of the heat insulating member 63 is lower than the thermal conductivity of each of the permanent magnet 61 and the holding member 62. When the body portion 23 is made of SUS304, the thermal conductivity of the body portion 23 is, for example, 16.7 W/m·K. The thermal conductivity of the permanent magnet 61 is, for example, approximately 1 to 50 W/m·K, the thermal conductivity of the holding member 62 is, for example, approximately 100 to 400 W/m·K, and the thermal conductivity of the heat insulating member 63 is, for example, approximately 0.1 to 0.5 W/m·K. The thermal conductivity can be measured by general measurement methods such as a heat flow meter method, a laser flash method, and a hot wire method.

As illustrated in FIGS. 1, 3, 4, and 6, the heat radiating unit 7 includes a heat sink 70 that radiates heat generated in the target 4, and a cooling unit 80 that cools the heat sink 70, and is disposed outside the housing 2. The heat sink 70 is made of, for example, a metal material such as aluminum. A thermal conductivity of the heat sink 70 is higher than the thermal conductivity of each of the body portion 23 and the permanent magnet 61. The thermal conductivity of the heat sink 70 is, for example, approximately 100 to 400 W/m·K. The heat sink 70 includes a first portion 71 and a second portion 72.

The first portion 71 is formed in a circular plate shape coaxial with the tube axis AX, and includes an opening 71*b* in a central portion thereof. The first portion 71 extends perpendicularly to the tube axis AX along the surface 24*a* of the lid portion 24, and the protrusion 26 is disposed in the opening 71*b*. The first portion 71 surrounds the protrusion 26 when viewed in the axial direction A. A surface of the first portion 71 on the second side S2 is in contact with the surface 24*a* of the lid portion 24 via a heat conducting member 8 having a sheet shape. Accordingly, the first portion 71 is thermally connected to the surface 24*a* of the lid portion 24. The heat conducting member 8 is, for example, a silicone sheet made of a silicone having a high thermal conductivity in a circular sheet shape, is disposed between an entirety of the surface 24*a* and the first portion 71, and is in close contact with the surface 24*a* and the first portion 71. Since the heat conducting member 8 intervenes between the first portion 71 and the lid portion 24, heat conduction between the first portion 71 and the lid portion 24 can be more promoted than when the first portion 71 and the lid portion 24 that are made of a metal material are in direct contact with each other.

As illustrated in FIG. 4, the first portion 71 is slightly separated from the protrusion 26 in the radial direction. A distance L1 between the first portion 71 and the protrusion 26 in the radial direction is smaller than a protrusion height L2 of the protrusion 26 from the surface 24*a* of the lid portion 24 in the axial direction A, and is smaller than a diameter L3 of the protrusion 26 (width of the protrusion 26 in the radial direction). The first portion 71 may be in contact with the protrusion 26. The first portion 71 does not protrude to the first side S1 with respect to the protrusion 26. In other words, when a surface 71*a* of the first portion 71 on the first side S1 and the surface 26*a* of the protrusion 26 on the first side S1 are flat, the surface 71*a* is located on the same plane as the surface 26*a* or is located closer to the second side S2 than the surface 26*a*. In this example, the surface 71*a* is located on the same plane as the surface 26*a*. In addition, the surface 71*a* is located on the same plane as the surface 5*a* of the X-ray-emitting window 5 on the first side S1.

The second portion 72 is formed in a substantially cylindrical shape concentric with the first portion 71, and extends from an outer edge of the first portion 71 to the second side S2. The second portion 72 is located outside an outer edge of the surface 24*a* of the lid portion 24 when viewed in the axial direction A, and is located closer to the second side S2 in the axial direction A than the surface 24*a*. In this example, an entirety of the second portion 72 is located closer to the second side S2 than the surface 24*a*, but only a part of the second portion 72 may be located closer to the second side S2 than the surface 24*a*. The second portion 72 overlaps a part of the body portion 23 in the radial direction, and covers a part of the outer peripheral surface of the body portion 23. The second portion 72 is slightly separated from the body portion 23 in the radial direction, but may be in contact with the body portion 23. A surface 72*b* of the second portion 72 on the second side S2 is in contact with a surface on the first side S1 of the holding member 62 of the deflection unit 6, and is thermally connected to the deflection unit 6.

A plurality of fins 72*a* are formed in an outer peripheral surface of the second portion 72. Each of the fins 72*a* is formed in a substantially circular plate shape concentric with the second portion 72. The plurality of fins 72*a* are disposed parallel to each other and side by side at equal intervals along the axial direction A. Air from a cooling fan 84 to be described later is supplied to the fins 72*a*.

The cooling unit 80 includes an air blowing unit 81 and a surrounding portion 82 formed in a substantially cylindrical shape to surround the heat sink 70. The air blowing unit 81 includes a hood portion 83 and the cooling fan 84. The hood portion 83 covers one side of the cylindrical member 111 in the direction perpendicular to the axial direction A, and forms a space 83*a*. The cooling fan 84 is disposed in the space 83*a*. A plurality of through-holes are formed as a ventilation portion 83*b* in the hood portion 83. The cooling fan 84 sends outside air to the surrounding portion 82 as cooling air, the outside air being suctioned from the ventilation portion 83*b*.

The surrounding portion 82 includes an upper wall portion 82*a* and a side wall portion 82*b*. The upper wall portion 82*a* is formed in an annular shape, and defines an opening 82*c* on the first side S1 of the surrounding portion 82. The surrounding portion 82 is disposed such that the surface 71*a* of the first portion 71 on the first side S1 is exposed from the opening 82*c*. The side wall portion 82*b* is formed in a cylindrical shape, and surrounds the plurality of fins 72*a*, together with the upper wall portion 82*a*. The surrounding portion 82 forms a flow path through which the cooling air sent from a communication portion between the air blowing unit 81 and the surrounding portion 82 circulates so as to flow through spaces between the plurality of fins 72*a* in a circumferential direction. Accordingly, a heat radiation efficiency of the heat sink 70 can be improved. Incidentally, the cooling air is exhausted from a ventilation portion (not illustrated) provided in the side wall portion 82*b*. Accordingly, it is possible to make it difficult for the exhausted cooling air to flow to an inspection object side, and an influence of exhausting during imaging can be suppressed. In addition, the cooling fan 84 may operate to suction outside air from the ventilation portion provided in the side wall portion 82*b* and to exhaust the outside air from the ventilation portion 83*b* provided in the hood portion 83.

[Function and Effects]

In the X-ray generation device 100, the target 4 includes the electron-incident surface 4*a* and the X-ray-emitting surface 4*b*, transmits the X-ray XR generated when the electron beam B is incident on the electron-incident surface 4*a*, and emits the X-ray XR from the X-ray-emitting surface 4*b*. In such a transmission type configuration, the target 4 is more easily disposed close to the X-ray-emitting window 5 and the FOD can be more reduced than in a reflection type configuration in which an electron-incident surface also serves as an X-ray-emitting surface. In addition, the protrusion 26 protruding to the first side S1 is formed on the surface 24*a* of the housing 2, and the target 4 is disposed in the opening portion 27 formed in the protrusion 26. For this reason, the FOD can be further reduced. Then, the heat sink 70 includes the first portion 71 extending along the surface 24*a* and being thermally connected to the surface 24*a*. Accordingly, the heat sink 70 can be disposed using a space corresponding to the height of the protrusion 26, and heat generated in the target 4 can be satisfactorily radiated while suppressing an increase in FOD. Further, the heat sink 70 includes the second portion 72 extending from the first portion 71 to the second side S2 opposite the first side S1. Accordingly, heat radiation by the heat sink 70 can be improved while suppressing an increase in FOD. Therefore, the X-ray generation device 100 is capable of satisfactorily radiating heat generated in the target 4 while suppressing an increase in FOD.

A heat transfer path will be described with reference to FIGS. 4 to 6. As described above, a large amount of heat can be generated in the target 4. In the X-ray generation device 100, as indicated by arrows in FIGS. 4 to 6, heat generated in the target 4 is transferred from the protrusion 26 of the housing 2 to the lid portion 24. The heat transferred to the lid portion 24 is transferred to the first portion 71 of the heat sink 70 via the heat conducting member 8. The heat transferred to the first portion 71 is transferred to the second portion 72. Accordingly, the heat generated in the target 4 can be effectively radiated by the heat sink 70. In addition, since the thickness is increased by the protrusion 26, the heat capacity of a region thermally connected to the target 4 can be increased.

Here, when the protrusion 26 is not provided, the target 4 is disposed closer to the second side S2, and the FOD is increased by an amount corresponding to a thickness of the first portion 71 of the heat sink 70, so that the advantages of the transmission type X-ray tube are impaired. In this case, when the first portion 71 of the heat sink 70 is omitted, an increase in FOD can be suppressed, but heat generated in the target 4 cannot be effectively radiated. Therefore, the protrusion 26 is provided, so that the position of the target 4 is brought close to the inspection object and the heat sink 70 is disposed using the space corresponding to the height of the protrusion 26, which is very effective in satisfactorily radiating heat generated in the target 4 while suppressing an increase in FOD.

In addition, when the heat sink 70 protrudes farther to the first side S1 than the surface 26*a* on the first side S1 of the protrusion 26, the FOD is increased, and the advantages of the transmission type X-ray tube are impaired. The reason for the concern is that the inspection object comes into contact with the heat sink 70 and the inspection object cannot be brought close to the X-ray focal point F. On the other hand, in the X-ray generation device 100, the heat sink 70 does not protrude to the first side S1 with respect to the protrusion 26. Accordingly, the FOD can be further reduced. In addition, the surface 71*a* of the first portion 71 of the heat sink 70 on the first side S1 is located on the same plane as the surface 26*a* of the protrusion 26 on the first side S1. Accordingly, the thickness of the first portion 71 can be secured and heat radiation by the heat radiating unit 7 can be improved while suppressing an increase in FOD. In addition, heat radiation by the heat sink 70 can also be improved by shortening a distance from a heat generation portion (X-ray focal point F) to the first portion 71.

The second portion 72 is located outside the outer edge of the surface 24*a* of the housing 2 when viewed in the axial direction A, and is located closer to the second side S2 in the axial direction A than the surface 24*a*. Accordingly, heat radiation by the heat sink 70 can be improved while suppressing an increase in FOD.

The first portion 71 surrounds the protrusion 26 when viewed in the axial direction A. Accordingly, heat generated in the target 4 can be more satisfactorily radiated.

The surface 5*a* of the X-ray-emitting window 5 on the first side S1 is located on the same plane as the surface 71*a* of the first portion 71 on the first side S1. Accordingly, the FOD can be further reduced.

The heat conducting member 8 is disposed between the first portion 71 and the surface 24*a* of the housing 2. Accordingly, heat generated in the target 4 can be more satisfactorily radiated.

The second portion 72 includes the plurality of fins 72*a*. Accordingly, heat radiation by the heat radiating unit 7 can be further improved.

The deflection unit 6 is provided which deflects the electron beam B by means of the magnetic force of the permanent magnets 61, and the second portion 72 is thermally connected to the deflection unit 6. Accordingly, the position of the X-ray focal point F can be moved to a desired position by the deflection unit 6. In addition, when heat generated in the target 4 is transferred to the permanent magnet 61, the permanent magnet 61 is heated and the magnetic force decreases. In this case, the amount of deflection of the electron beam B is changed, and the position of the X-ray focal point is changed. For example, when the position of the X-ray focal point is changed during continuous imaging by computed tomography (CT) or the like, an acquired image is blurred. In contrast, in the X-ray generation device 100, even when heat generated in the target 4 is transferred to the deflection unit 6, the heat can be released to the heat radiating unit 7. As a result, the heating of the permanent magnets 61 by the heat generated in the target 4 can be suppressed, and the X-ray can be stably output.

Modification Examples

Figure 8:
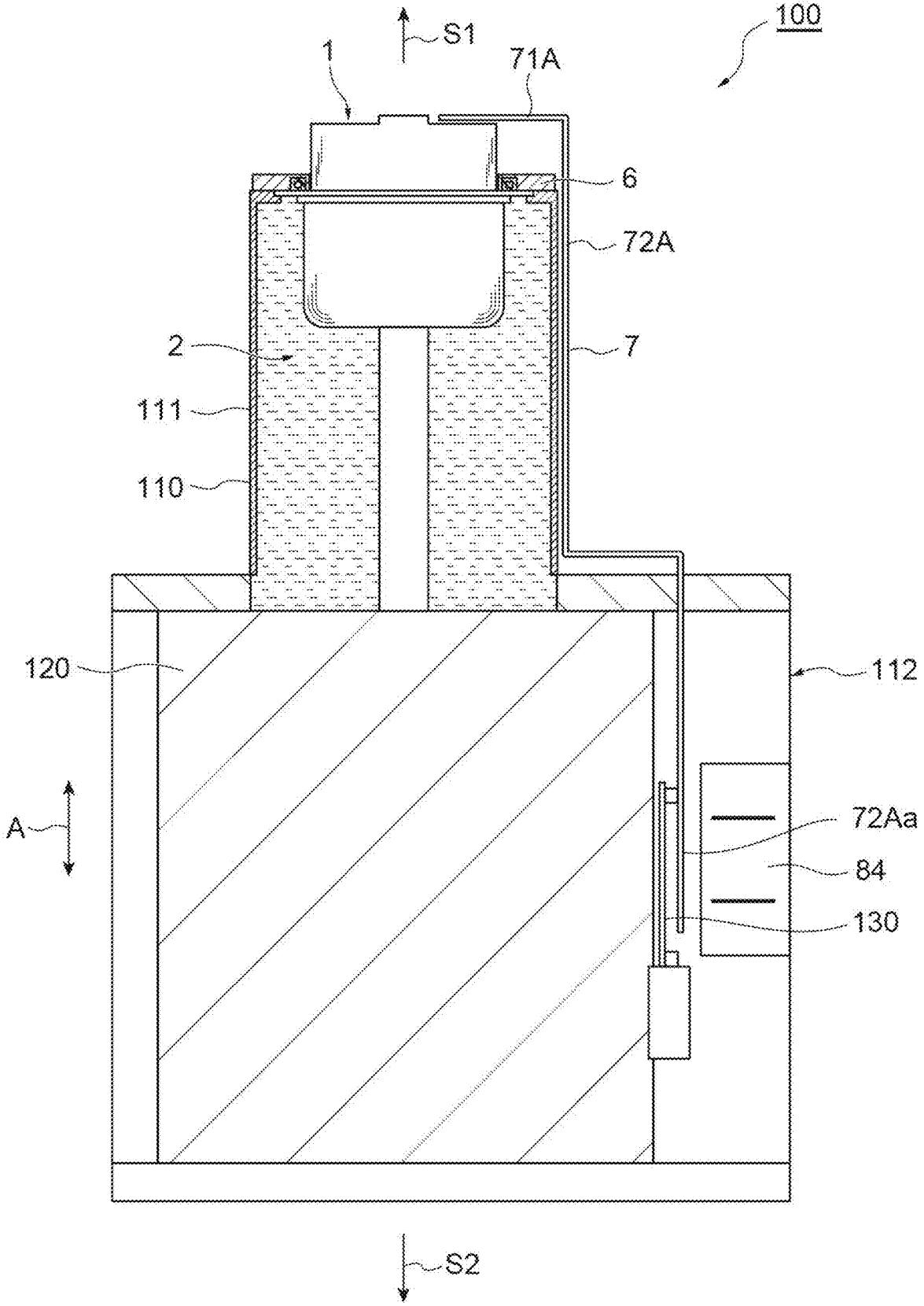
FIG. 8 is a cross-sectional view of an X-ray generation device according to a first modification example.

In a first modification example illustrated in FIG. 8, a first portion 71A and a second portion 72A of the heat radiating unit 7 are formed in a pipe shape. The first portion 71A linearly extends perpendicularly to the tube axis AX along the surface 24*a* of the lid portion 24, and is thermally connected to the surface 24*a*. The first portion 71A may be disposed in an annular shape (spiral shape) or in such a manner that a linear portion is folded, on the surface 24*a* of the lid portion 24. In this case, the thermal connection area can be further increased. The second portion 72A extends from the first portion 71A to the second side S2. In this example, the first portion 71A and the second portion 72A form a heat pipe, and a hydraulic fluid is sealed thereinside.

In the first modification example, the cooling fan 84 is disposed in the power source unit case 112. The second portion 72A extends to the vicinity of the cooling fan 84 to include a facing portion 72Aa facing the cooling fan 84. The cooling fan 84 is also used to cool a control substrate 130 disposed in the power source unit case 112. Namely, in the first modification example, one cooling fan serves as both a cooling fan that radiates heat generated in the target 4 and a cooling fan that cools the control substrate 130. Accordingly, low cost can be achieved. In addition, since the cooling fan 84 is disposed at a position away from the target 4 (X-ray tube 1), a failure of the cooling fan 84 caused by X-ray exposure can be suppressed. For example, the control substrate 130 controls operation of the power source unit 120. The control substrate 130 faces the facing portion 72Aa.

Also in the first modification example, similarly to the above embodiment, heat generated in the target 4 can be satisfactorily radiated while suppressing an increase in FOD. In addition, since the first portion 71A and the second portion 72A are formed in a pipe shape, the first portion 71A and the second portion 72A can be used as a heat pipe or the like, and heat radiation by the heat radiating unit 7 can be improved. In addition, since heat can be transported over a long distance, as described above, the cooling fan 84 can be disposed at a position away from the target 4.

Figure 9:
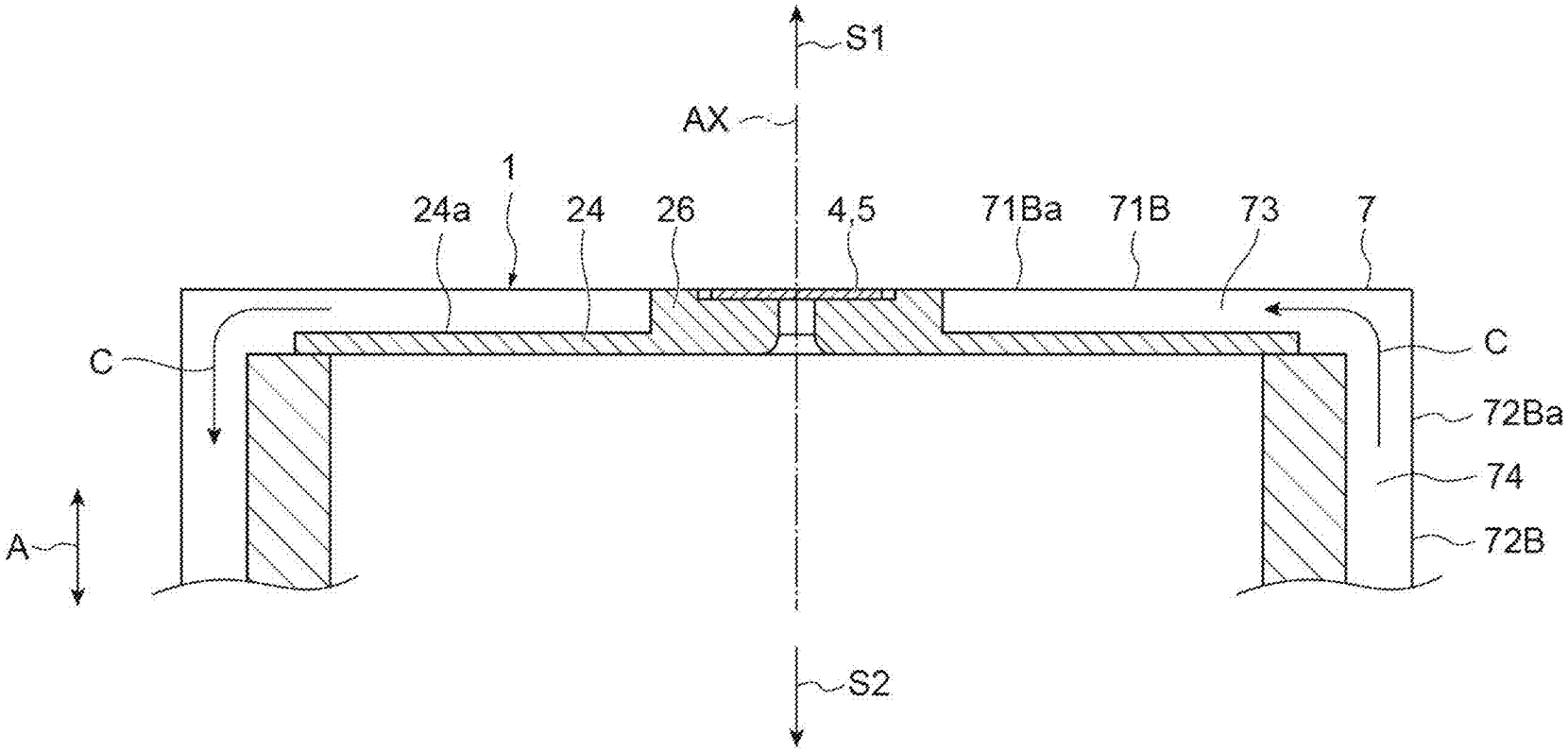
FIG. 9 is a cross-sectional view of an X-ray generation device according to a second modification example.

The heat radiating unit 7 may be configured as in a second modification example illustrated in FIG. 9. In the second modification example, a first portion 71B and a second portion 72B of the heat radiating unit 7 include members 71Ba and 72Ba that define flow paths 73 and 74 between the housing 2 and the first and second portions 71B and 72B, respectively, a cooling medium C flowing through the flow paths 73 and 74. The member 71Ba is formed in an annular plate shape coaxial with the tube axis AX, and defines the flow path 73 having an annular shape coaxial with the tube axis AX on the surface 24*a* of the lid portion 24. The first portion 71B is formed of the member 71Ba and the flow path 73. The first portion 71B extends along the surface 24*a* of the lid portion 24, and is thermally connected to the surface 24*a*. The second portion 72B is formed in a cylindrical shape concentric with the first portion 71B, and defines the flow path 74 having a cylindrical shape concentric with the first portion 71B on the outer peripheral surface of the body portion 23. The second portion 72B is formed of the member 72Ba and the flow path 74. The second portion 72B extends from the first portion 71B to the second side S2 along the axial direction A.

Also in the second modification example, similarly to the above embodiment, heat generated in the target 4 can be satisfactorily radiated while suppressing an increase in FOD. In addition, since the first portion 71B and the second portion 72B define the flow paths 73 and 74 between the housing 2 and the first and second portions 71B and 72B, respectively, for letting the cooling medium C flowing, heat radiation by the heat radiating unit 7 can be further improved.

The present disclosure is not limited to the above embodiment. The materials and the shapes of the configurations are not limited to the materials and the shapes described above, and various materials and shapes can be adopted. The first portion 71 may not surround the protrusion 26 when viewed in the axial direction A, and may be formed in a shape other than an annular shape. The heat sink 70 may protrude farther to the first side S1 than the surface 26*a* of the protrusion 26 on the first side S1. The deflection unit 6 may be omitted. The heat conducting member 8 may be omitted. In the above embodiment, forced air cooling is performed using the cooling fan 84, but the cooling fan 84 may be omitted and natural air cooling may be performed. The cooling fan 84 may be provided adjacent to the fins 72*a*. The heat radiating unit 7 may be a cooling mechanism other than the above-described example. In the first modification example, the first portion 71A and the second portion 72A may form a cooling water pipe for letting cooling water flowing. Even in this case, similarly to the first modification example, heat radiation by the heat radiating unit 7 can be improved. In addition, at least a part of the deflection unit 6 or the heat radiating unit 7 may be integrated with the X-ray tube 1. In the above embodiment, the X-ray module forms the X-ray generation device 100; however, the X-ray module may not necessarily form the X-ray generation device, and may include, for example, only the X-ray tube 1 and the heat radiating unit 7 (heat sink 70).

What is claimed is:

1. An X-ray module comprising:

a housing in which an opening portion is formed;

an electron gun that emits an electron beam inside the housing;

a target that includes an electron-incident surface and an X-ray-emitting surface opposite the electron-incident surface, and that transmits an X-ray generated when the electron beam is incident on the electron-incident surface and emits the X-ray from the X-ray-emitting surface;

an X-ray-emitting window that seals the opening portion, and that transmits the X-ray emitted from the target and emits the X-ray to a first side in an axial direction; and a heat radiating unit disposed outside the housing, wherein the housing includes a surface on which a protrusion protruding to the first side is formed, the opening portion is formed in the protrusion, and the target is disposed in the opening portion, and the heat radiating unit includes a first portion extending along the surface and thermally connected to the surface, and a second portion extending from the first portion to a second side opposite the first side.

2. The X-ray module according to claim 1, wherein the second portion is located outside an outer edge of the surface when viewed in the axial direction, and is located closer to the second side in the axial direction than the surface.

3. The X-ray module according to claim 1, wherein the first portion surrounds the protrusion when viewed in the axial direction.

4. The X-ray module according to claim 1, wherein the heat radiating unit does not protrude to the first side with respect to the protrusion.

5. The X-ray module according to claim 1, wherein a surface of the heat radiating unit on the first side is located on the same plane as a surface of the protrusion on the first side.

6. The X-ray module according to claim 1, wherein a surface of the X-ray-emitting window on the first side is located on the same plane as a surface of the heat radiating unit on the first side.

7. The X-ray module according to claim 1, further comprising:

a heat conducting member disposed between the first portion and the surface.

8. The X-ray module according to claim 1, wherein the second portion includes a plurality of fins.

9. The X-ray module according to claim 1, wherein the first portion and the second portion are formed in a pipe shape.

10. The X-ray module according to claim 1, wherein each of the first portion and the second portion includes a member defining a flow path between the housing and the member for letting a cooling medium flowing.

11. The X-ray module according to claim 1, further comprising:

a deflection unit that includes a permanent magnet, and that deflects the electron beam by means of a magnetic force of the permanent magnet, wherein the second portion is thermally connected to the deflection unit.

* * * * *